US006058532A

United States Patent [19]

Allen

[11] Patent Number: 6,058,532

[45] Date of Patent: May 9, 2000

[54] APPARATUS FOR ELEVATING ONE END PORTION OF A BED FRAME

[76] Inventor: Newton P. Allen, 4230 Harding Rd., Suite 400, Nashville, Tenn. 37205

[21] Appl. No.: 09/050,629

[22] Filed: Mar. 30, 1998

[51] Int. Cl.[7] ..... A47C 19/04

[52] U.S. Cl. ..... 5/509.1; 5/658

[58] Field of Search ..... 5/616, 509.1, 660, 5/634, 11, 659, 658; 254/102, 92, 7 C, 7 R, 6 R, 95, 105, 113, 119, 134, 100

[56] References Cited

U.S. PATENT DOCUMENTS

| | | | |
|---|---|---|---|
| 992,080 | 5/1911 | Swanger | 5/11 X |
| 1,096,316 | 6/1914 | Noble . | |
| 1,401,554 | 12/1921 | Phillips | 5/11 X |
| 2,072,791 | 3/1937 | Baer | 5/11 X |
| 2,522,759 | 9/1950 | Lindquist | 5/63 |
| 3,073,635 | 1/1963 | Schaefer | 287/108 |
| 3,247,528 | 4/1966 | Swenson et al. | 5/62 |
| 3,310,289 | 3/1967 | Burke | 254/126 |
| 4,312,088 | 1/1982 | Webb | 5/509 |
| 4,654,903 | 4/1987 | Chubb et al. | 5/61 |
| 4,715,073 | 12/1987 | Butler | 5/62 |
| 4,856,129 | 8/1989 | Butler | 6/62 |
| 5,172,442 | 12/1992 | Bartley et al. | 5/11 X |
| 5,224,227 | 7/1993 | McGinley | 5/509 |
| 5,345,631 | 9/1994 | Saperstein et al. | 5/509.1 |
| 5,379,987 | 1/1995 | Cleary | 254/134 |
| 5,566,412 | 10/1996 | Arnold | 5/509.1 X |
| 5,713,091 | 2/1998 | Houchin | 5/660 |

*Primary Examiner*—Terry Lee Melius
*Assistant Examiner*—Fredrick Conley
*Attorney, Agent, or Firm*—Garvey, Smith, Nehrbass & Doody, L.L.C.

[57] ABSTRACT

An lifting apparatus for elevating a selected end portion (e.g., head or foot) of a bed frame is fully removable from the bed frame so that it can be added quickly to either end of the bed frame or to a different bed frame. This is accomplished by providing a single removable connection between the feet of the bed frame and receptacles at opposed end portions of a support beam. The support beam member has opposed ends with the receptacles and an elevated portion with an underside that receives extendable portions of a pair of screw jacks. A reversible motor drive and an interface are provided so that rotation of the single motor drive in a selected direction operates both jacks to simultaneously move the beam member and the bed frame between minimum and maximum elevational positions. The user is provided with a control that operates the motor drive, the control having "up", "down" and "stop" control positions. An electrical cable interfaces the control with the motor drive.

5 Claims, 3 Drawing Sheets

APPARATUS FOR ELEVATING ONE END PORTION OF A BED FRAME

BACKGROUND OF THE INVENTION

1. Field of the Invention

The present invention relates to an apparatus for elevating one end portion of a bed such as the head board portion for maintaining one's head elevated slightly above the chest or torso while recumbent, as is medically necessary for a great number of individuals with ailments such as gastro-esophogeal reflux, congestive heart failure, sleep apnea, chronic sinusitis, or edema of the arm. More particularly, the present invention relates to an improved bed lift apparatus that can be selectively positioned by a user under either the head or foot end portion of a bed frame so that after retiring, one may simply push a button to selectively raise the head or foot end portion of a bed. Even more particularly, the present invention relates to an improved electrical bed lift apparatus that uses a single electrical drive motor interfaced with a gear box having two rotary drive shafts for operating a pair of spaced apart screw jacks, each jack having a traveling nut portion that elevates an adjustable beam that supports the head or foot end of the bed frame, the beam including receptacles at a lower elevation that receive two of the casters or feet of the bed.

2. General Background of the Invention

Maintaining one's head elevated slightly above the chest or torso while recumbent is medically advantageous for a great number of individuals with ailments such as gastro-esophageal reflux, congestive heart failure, sleep apnea, chronic sinusitis, and edema of the arm.

Gastro-esophageal reflux is a very common problem affecting persons of all walks of life. Pregnant women are plagued by reflux in the middle and final trimesters of pregnancy. Overweight men and women may have reflux of gastric contents chronically. This causes esophageal strictures and, in come cases, cancer of the lower esophagus.

Since this problem is exacerbated when recumbent, reflux often leads to chest pain in the early morning hours. Treatment may consist of several strategies. First, eating early in the evening several hours before retiring lessens reflux. Second, medications can decrease reflux and decrease the acidity of the refluxed gastric contents. Third, gravity can be used to lessen reflux by elevating the head of one's bed. A mattress wedge, or bricks or blocks have been used but these are not aesthetically pleasing and are frequently awkward or difficult in manipulation.

One of the solutions for elevating one's head slightly above the chest while recumbent is to use an elevating mechanism. Many such bed elevating mechanisms have been patented. Some of these elevating mechanisms are complex mechanisms that are permanently attached to, or a part of, the bed. Other mechanisms are simpler, being placed underneath the feet (legs) or casters of the bed. Still others are adjustable to different elevational positions.

The Lindquist U.S. Pat. No. 2,522,759 discloses an adjustable bed which has a built-in elevating mechanism. The device uses a manual cranking arrangement to selectively raise or lower the head or foot portion of the bed. This apparatus would not be useful as a elevating device for use with any standard or differently sized bed frame since the apparatus is permanently incorporated into the bed frame, providing complicated gearing and internal telescoping portions as part of the overall mechanism. The Swenson U.S. Pat. No. 3,247,528 discloses a bed with a permanently incorporated bed tilting mechanism. The apparatus includes a plurality of pulleys and cables that are used to elevate the person's head, foot, or the middle portion of the bed or a combination thereof.

The Schaefer U.S. Pat. No. 3,073,635 entitled "Shaft Coupling" discloses a hospital bed that includes a head board and foot board with a mattress support that can be elevated. The angle of the bed may be adjusted to suit various medical conditions. In that regard, the head board or foot board can be selectively or jointly elevated. The apparatus is permanently attached to and a part of the bed mechanism. The apparatus uses a motor that can be operated in either direction so that the head of the bed will be appropriately elevated or lowered.

The Burke U.S. Pat. No. 3,310,289 discloses a scissor-like elevator mechanism for an end of a bed. The Burke patent discloses basically a scissors jack that can be placed at the end or intermediate of a conventional bed in order to raise or lower the end portion, or the whole of the bed. The scissors jack lifts the bed frame at a position in between the feet rather than engaging and lifting the feet of the bed. Scissor jacks, if not enclosed, pose a substantial risk of pinch injury.

A portable bed adjusting device for patients and the like is disclosed in U.S. Pat. No. 4,312,088. The device includes bed elevating blocks adapted to be inserted under one end of the bed and longitudinally extending mattress retainers adapted to be inserted between the mattress and the mattress support such as the box spring, to secure the mattress against longitudinal movement when the bed is inclined. The bed elevating blocks include two separate connectable components that are adjustable relative to each other to provide elevation of one selected end of the bed. These blocks are in the form of threadably engaged portions that can be lengthened or shortened in order to attain the desired elevational position. The user must separately adjust each of the blocks before placing them under the appropriate end portions of the bed.

A bed sore prevention device in an bed arrangement for an invalid patient is the subject of U.S. Pat. No. 4,654,903. The '903 patent provides a reversible motor that drives a ball nut through a worm screw so that motion of the ball nut in one direction raises one side of the bed frame and motion in an opposite direction raises the opposite side of the bed frame. As with the Burke invention described above, scissor type apparatus presents a substantial exposure to pinch injuries, including loss of digits.

The Butler U.S. Pat. No. 4,715,073 discloses a tiltable bed frame assembly which permits one to adjust the angular disposition of a mattress between a horizontally disposed position and an inclined position while at the same time permitting one to utilize a conventional mattress and the head board and foot board components of the user's suite. The apparatus incorporates a ramp that is moved with a telescoping pushrod wherein casters travel up the inclined ramp in order to elevate one end of the bed.

The McGinley U.S. Pat. No. 5,224,227 discloses an elevator stand for a bed leg for tilting the bed for use by a person with various conditions. The stand has a base portion for resting on a floor surface, and has an upper receiving portion which has a top surface recess with a bottom bearing surface and an inner sidewall surface telescoping over the bed leg. The elevator is provided with a means for securing the legs of the bed to the elevators. The '227 patent is thus in the form of a static block placed under the legs of a bed.

Another elevator block for raising one end of a bed is seen in U.S. U.S. Pat. No. 5,345,631. The '631 patent discloses an apparatus for raising one end of the bed which comprises placement of elevator blocks under the support legs of the bed. Each of the blocks has top and bottom ends that are non-parallel planar surfaces. The planar surface of the top end is inclined to allow for proper mating of the top end of the elevator block with a bed leg in the bed's raised position. Provision is also made for a removable insert in a cavity of the top end of the elevator block, so that the bed legs can sit either within the cavity for increased stability or upon the top of the insert, depending upon the size of the bed leg. The use of slip-resistant materials on the surfaces contacting either the floor or bed leg also adds stability of the bed in the raised position. Thus, the '631 patent does not enable the bed to be selectively raised or lowered to any desired elevational position between a maximum and a minimum position but rather is a fixed elevation block member simply placed underneath the legs of the bed at the head end portion.

An inclinable bed frame assembly is disclosed in U.S. U.S. Pat. No. 5,566,412. The '412 patent uses multiple bed frame sections that pivot one with respect to the other. A scissor jack arrangement is used to raise an upper frame relative to a lower frame for elevating the entire mattress into a desired elevational position and at an angular elevation with respect to the underlying floor.

BRIEF SUMMARY OF THE INVENTION

The present invention provides an improved apparatus that eliminates problems and shortcomings of the prior art by providing a portable apparatus for elevating one end portion of a bed frame that includes a plurality of floor engaging feet. The apparatus may be used with any bed, and can be moved easily from one bed to another. The apparatus includes a support beam having opposed end portions, each with a receptacle for holding the lower end of one of the floor engaging feet of the bed frame.

The support member is in the form of an integral beam having a laterally extending span portion with a higher elevation and the pair of receptacles preferably being at a lower elevation for receiving the floor engaging feet or legs.

A pair of jacks are positioned respectively next to or adjacent the receptacles but spaced from the receptacles, each jack having a base for resting on the floor, a lifting portion for lifting the support beam member (including the receptacles) and a moving portion that elevates the lifting portion relative to the base.

A gear box includes a pair of opposed drive shafts that extend respectively to the pair of jacks for operating the pair of jacks between minimum and maximum elevational positions.

A reversible motor drive powers the gear box to rotate in selected rotational directions. A control is provided for controlling the motor drive, the control having "up", "down", and "stop" control positions. The motor drive is operated with the control by selecting the "up" or the "down" positions to activate the motor drive and simultaneously raise or lower the jacks by rotating the gear box and its drive shafts in selected rotational directions.

This enables a user to control elevation of either end of the bed by placing the apparatus under the selected head or foot portion, then activating the control to either raise, lower or stop the mechanism. The "up" and "down" control positions direct the motor drive to rotate in either of two rotational directions as selected. An electrical cable connects the control and the motor drive. Similarly, the gear box rotates in one of two different rotational directions corresponding to the rotational direction of the motor as dictated by the control. This rotation of the gear box in one of two rotational directions functions to elevate or lower the jacks, the beam and the bed frame feet that are resting on the opposed receptacles of the beam.

In a further embodiment of the invention, the motor drive may be equipped with a timed control such that the frame is elevated for selected (programmed) periods of time. Likewise, the control may raise or lower the bed frame end at selected times. By such programming a patient might fall asleep more readily on a level bed and the head end of the bed frame be raised for the therapeutic effect after the patient has fallen asleep.

The present invention provides a universal head board (or foot board) lift for a bed frame which may be adjusted to accommodate all sides of beds, as from the single (or twin size) to king size. The embodiments disclosed are relatively light weight and portable so that they may be moved from one bed to another as needs warrant. Likewise, a conventional household bed may be given a elevational feature avoiding the purchase of an expensive, heavy unit of hospital furniture.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
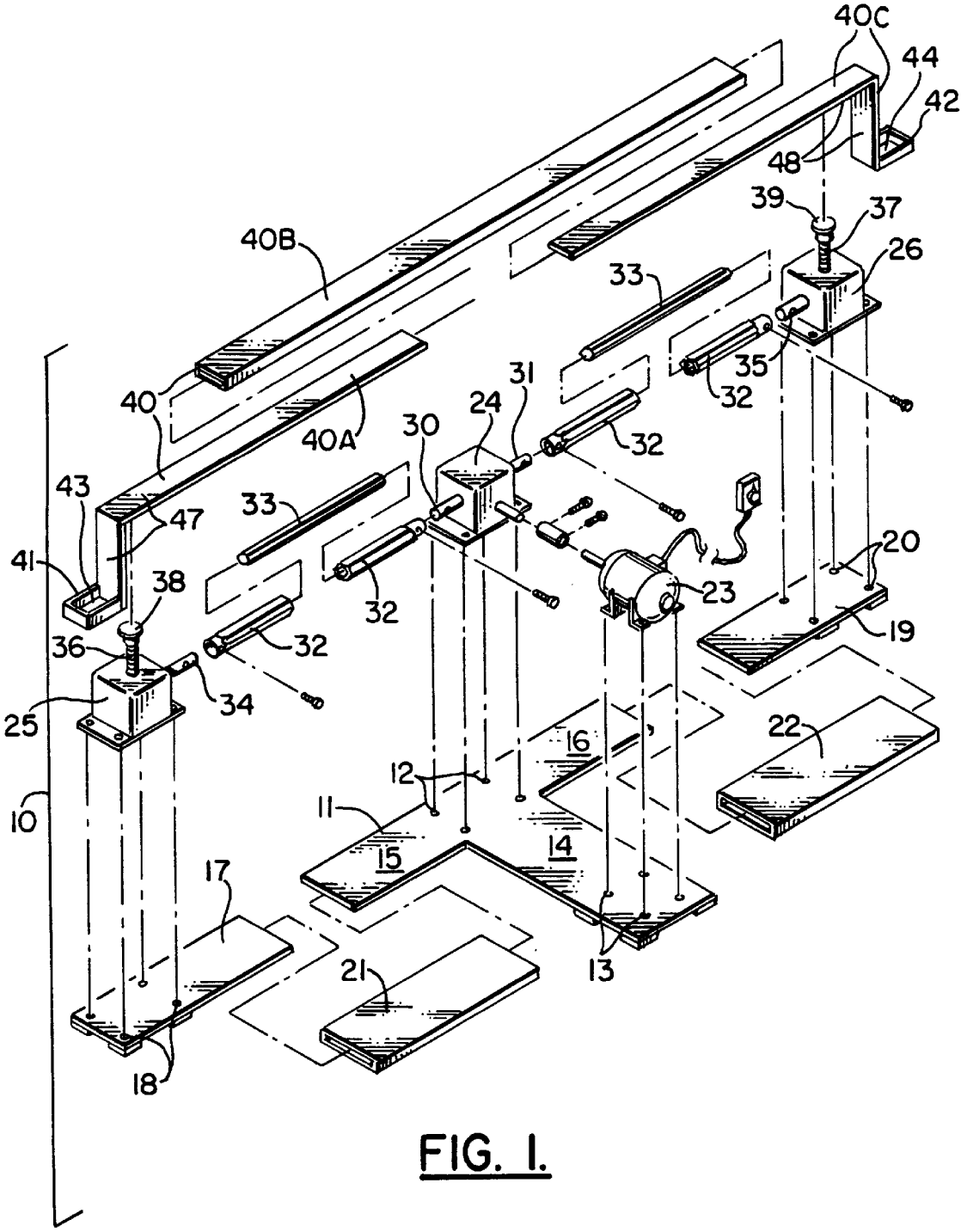
FIG. 1 is an exploded perspective view of the preferred embodiment of the apparatus of the present invention.
Figure 4:
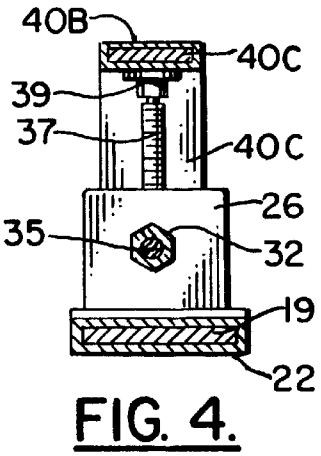
FIG. 4 is a sectional view taken along lines 4—4 of FIG. 2.
Figure 3:
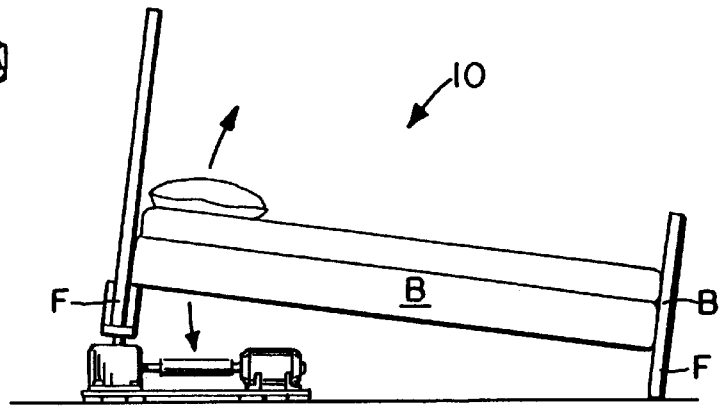
FIG. 3 is a side, elevational view of the preferred embodiment of the apparatus of the present invention.
Figure 2:
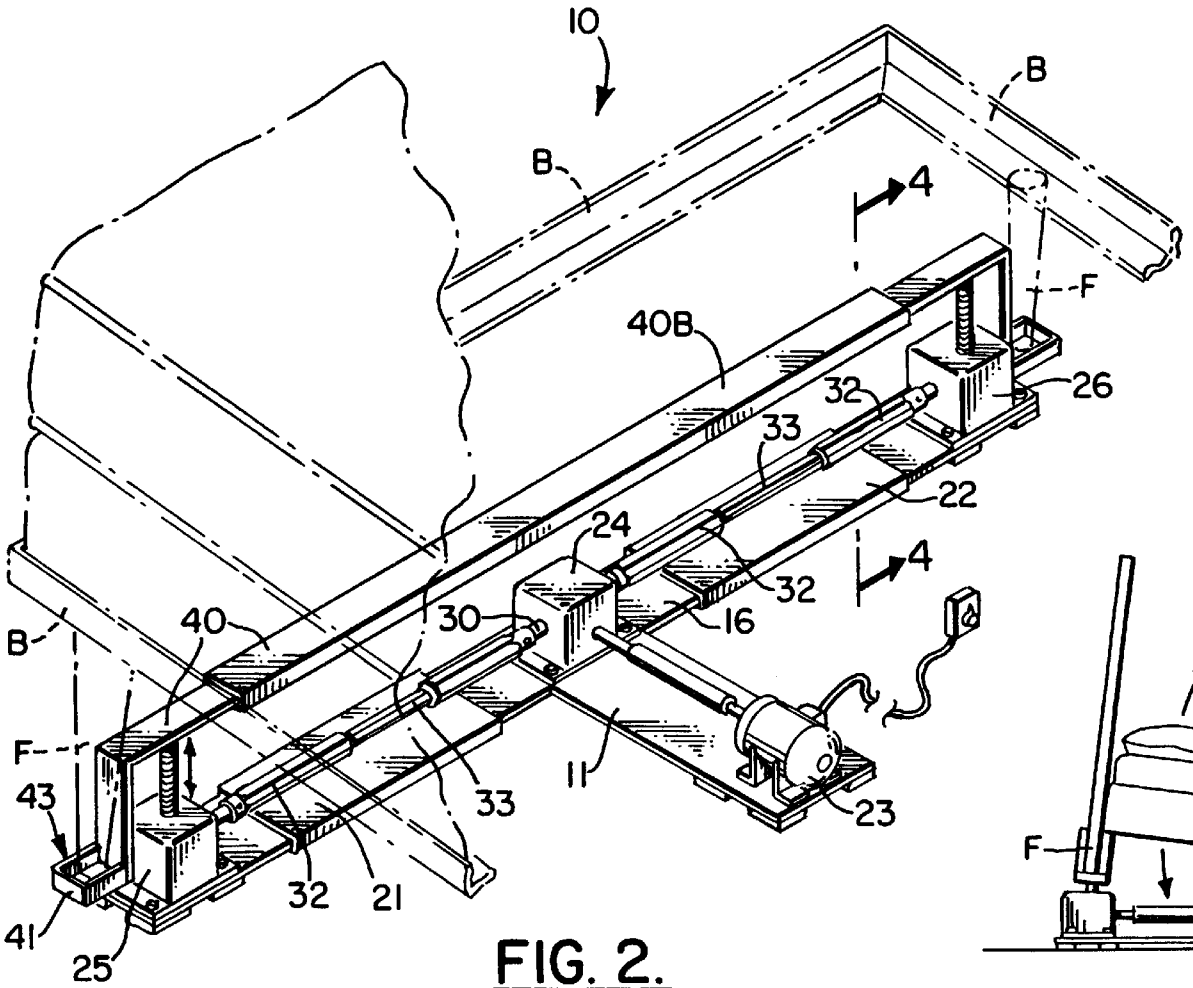
FIG. 2 is a perspective view of the preferred embodiment of the apparatus of the present invention.

FIGS. 1–3 show the preferred embodiment of the apparatus of the present invention designated generally by the numeral 10. Bed lifting apparatus 10 includes a base comprised of a motor drive/gear base plate 11 with first and second pluralities of openings 12, 13. The openings 12, 13 enable motor drive 23 and gear box 24 to be bolted to the base plate 11 at the respective openings 12, 13. Base plate 11 has a center section 14 and a pair of opposed side panels 15, 16.

A pair of jack base plates 17 and 19 are provided, each having respective pluralities of openings 18, 20. The openings 18 and 20 enable a pair of worm gear jacks 25, 26 to be bolted to the respective jack base plates 17, 19. Those skilled in the art will recognize that other fastening means such as welding or clamping means may be employed to secure the motion transmitting units on the respective bases.

A connection is formed between the motor drive/gear base plate 11 and the two jack base plates 17, 19 using telescope sleeve sections 21, 22. Each of these sleeve sections 21, 22 has a hollow open ended rectangular bore of uniform section that enables an end portion of the jack plate 17 or 19 to be received into the rectangular bore in telescoping fashion. Similarly, a side panel 15, 16 of base plate 11 fits respectively into the rectangular bore of a sleeve 21, 22.

A connection is formed between motor drive 23 and gear box 24 using coupling 29. The motor drive 23 has a motor shaft 27. Similarly, the gear box 24 has a gear box shaft 28. The coupling 29 forms a connection between the shafts 27, 28, so that rotation of the motor drive 23 similarly rotates the shaft 28 of gear box 24.

Motor drive 23 is a reversible motor that is rotatable in either rotary direction. Similarly, gear box shaft 28 rotates in one of two rotary directions with shaft 27 of motor drive 23. This rotation of motor 23 and gear box 24 corresponds to either "up" or "down" operation of the jacks 25, 26.

Control panel 50 interfaces with motor 23 via electrical cable 51. The control panel provides a three position switch with positions "up", "stop", and "down". This enables a user to select "up" for rotating motor 23 and gear box 24 in a direction that elevates each jack 25, 26. When the user selects "stop", the motor stops so that the bed stops in a selected elevational position. When the user selects "down" on the control panel 50, motor 23 and gear box 24 rotate in a direction that lowers each jack 25, 26. Control panel 5 may be adapted with a timer (commercially available) to add timed operation of motor 23 for, by example, raising and/or lowering the head at selected intervals or, at specific times of the day.

Both motor drive 23 and gear box 24 are commercially available. The gear box 24 provides a pair of opposed gear shafts 30, 31. Each of the shafts 30, 31 is respectively coupled to a screw jack drive shaft 34, 35 using means such as hexagonal shafts 33 and connecting sleeves 32. Illustratively, each sleeve 32 is hollow, providing an open ended bore that is hexagonal in transverse cross section and shaped to conform to the hexagonal outer surface of shaft 33. Similarly, shafts 30, 31 of gear box 24 and shafts 34, 35 of jacks 25, 26 can be hexagonally shaped to closely fit the hexagonal bore of sleeves 32. Alternatively, keys or pins 49 can be used to affix shafts 34, 35 of jacks 25, 26 to sleeves 32. Likewise, an alternative motor and jacking means might include a hydraulic pump, associated lines and hydraulic jacks to provide the lifting motion of bed frame B.

Each of the screw jacks 25, 26 has a vertical elevating portion 36, 37 respectively, and an upper surface 38, 39 respectively. The upper surfaces 38, 39 that form a connection (bolting or welding, for example) with a side section 40A, 40C respectively of beam 40. The support beam 40 is a structural member that (in the illustrated preferred embodiment) defines a telescoping support beam member for raising and lowering the head or foot section of a bed when the screw jacks 25, 26 are simultaneously elevated or lowered.

Beam 40 preferably includes three sections including side section 40A, center sleeve section 40B, and side section 40C. Sleeve section 40B has a rectangular, open-ended bore that receives the two side sections 40A, 40C so that the width of the beam 40 can be varied from, for example, about 36 inches minimum to about 72 inches maximum. Two preferred embodiments of bed lifting apparatus 10 may incorporate beam 40 to include sections 40A, 40B and 40C which are sized for adjustment to correspond to 1) twin and full sized beds [i.e., adjustable from about 32 inches to about 58 inches] and 2) queen and king sized beds [i.e., adjustable from about 56 inches to about 76 inches]. Beam 40 provides a pair of platform means 43, 44 preferably including opposed receptacles 41, 42 that receive the feet F of a bed frame B securely therein. In FIGS. 1–2, the beam side sections 40A and 40C have L-shaped ends 47, 48 that include the receptacles 41, 42. In the illustrated embodiment, platform means includes flat plates 43, 44 disposed respectively adjacent each receptacle, and on which rests a foot F of the bed frame B. Each of the receptacles 41, 42 may have a side wall 45, 46, respectively for securely retaining the foot F of the bed frame B so that it does not slip off of the flat plate 43, 44 portion of receptacle 41, 42. Likewise, flat plates 43, 44 may be disposed at an angle of about 90° such that the headboard or footboard may be disposed adjacent but beyond (with respect to support beam 40) to accommodate beds with solid head boards or foot boards. The positioning of flat plates 43, 44 below at least a portion of the support beam 40 a distance equivalent to the vertical dimension of screw jacks 25, 26 enables the head or foot of bed frame B to be lowered to essentially floor level.

The present invention thus provides an improved bed lifting apparatus that is fully adjustable to accommodate various widths of bed frames. The adjustability is provided in the form of the adjustable width of beam 40, the telescoping connection formed between hexagonal shafts 33 and the sleeves 32. Also, a telescoping connection is formed between the motor drive/gear base plate 11 and sleeves 21, 22 with jack plates 17, 19.

Figure 5:
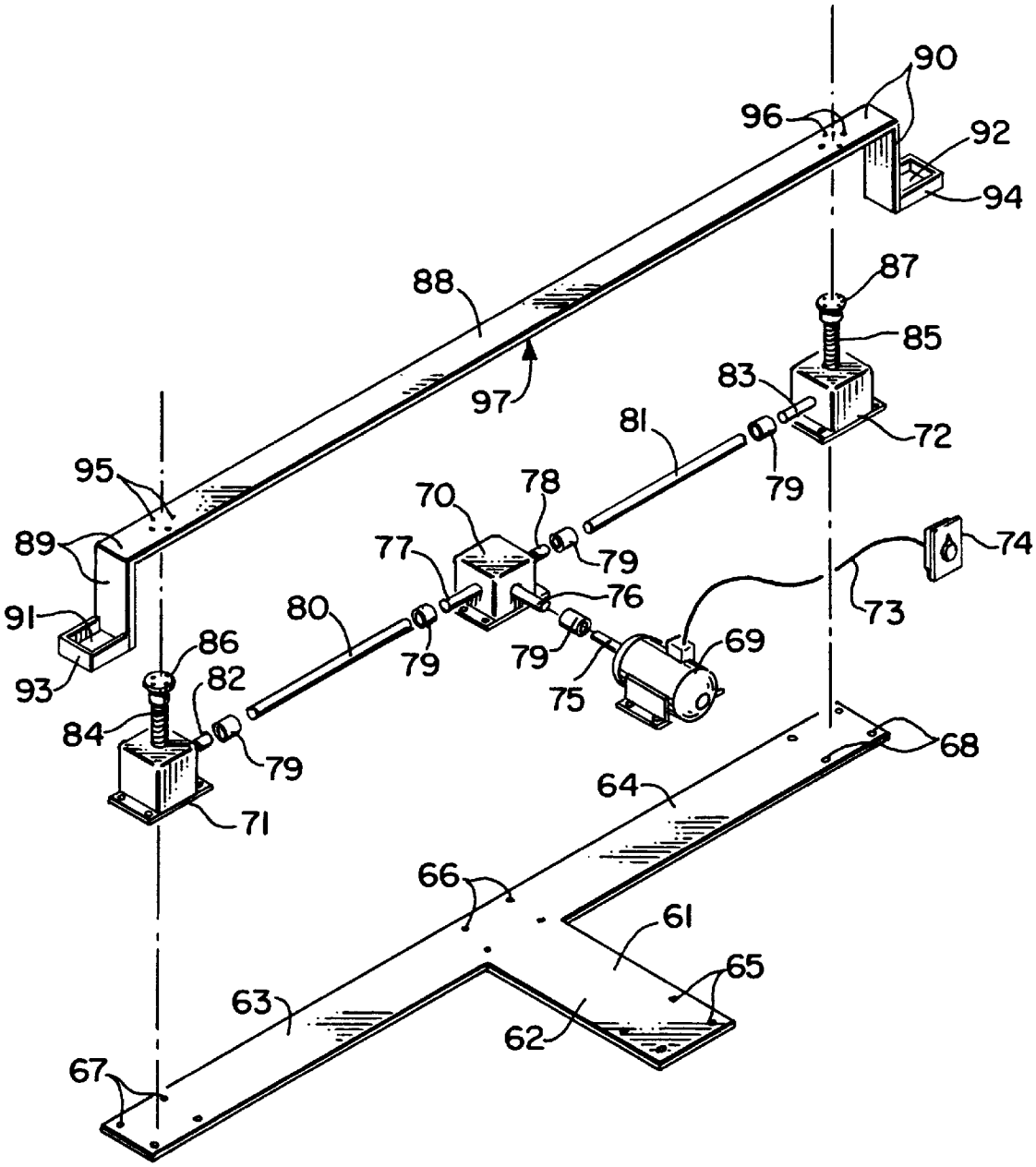
FIG. 5 is an exploded perspective view of an alternate embodiment of the apparatus of the present invention.

FIG. 5 is a perspective exploded view of an alternate embodiment of the apparatus of the present invention, designated generally by the numeral 60. Bed lifting apparatus 60 is similar to the preferred embodiment of FIGS. 1–5. The difference is that the embodiment of FIG. 5 does not provide the telescoping beam 40 and telescoping base plate 11 construction of FIGS. 1–4. Rather, the embodiment of FIG. 5 provides a base plate 61 and beam 88 that are of a fixed length so that the embodiment of FIG. 5 is useful with a particular bed of a particular width such as twin size, queen size, king size, etc.

Bed lifting apparatus 60 in FIG. 5 includes a motor drive/gear base plate 61 having a plurality of openings for mounting the various components to the base plate 61. The base plate 61 includes a center section 62 and a pair of side sections 63, 64. The openings include openings 65 for enabling the motor drive 69 to be attached (e.g., bolting, rivets, etc.) to the base plate 61 at the openings 65. The opening 66 enable gear box 70 to be bolted to base plate 61. Openings 67, 68 are spaced apart sets of openings that receive a jack 71, 72 respectively (e.g., bolted or riveted thereto).

As in the preferred embodiment, the motor drive 69 is a commercially available reversible type electric motor. Motor drive 69 is controlled via cable 73 by control panel 74. The control panel 74 includes three positions including "up", "stop", and "down" as with the preferred embodiment. Gear box 70 can be a commercially available gear box that has a gear box drive shaft 76 for connecting to the drive shaft 75 of motor drive 69 using sleeve 79.

The gear box 70 has a pair of shafts 78, 79 that extends from its sides respectively in the direction of jacks 71, 72, as shown in FIG. 5. Each of the jacks 71, 72 has a drive shaft 82, 83 respectively that is connected to and rotates with the respective shafts 77, 78 of gear box 70. The connection between shaft 82 of jack 71 and gear box 70 at shaft 77 can be in the form of an elongated shaft 80 connected to shafts 77 and 82 using sleeves 79. Similarly, the connection between shaft 78 of gear box 70 and shaft 83 of jack 72 can be in the form of shaft 81 and sleeves 79. The sleeves 79 can be attached to the shafts at the positions shown in FIG. 5 using welded connections, threaded connections, pinned connections, keyways, or other means known in the art for forming a connection between two generally cylindrically-shaped shaft members.

Each jack 71, 72 has a respective vertical elevating portion 84, 85 and an upper surface 86, 87. These surfaces 86, 87 are connected to the underside 97 of beam 88. The beam 88 is an elongated beam having a pair of L-shaped end portions 89, 90 as shown in FIG. 5. Openings 95, 96 respectively at each of the end portions 89, 90 can be used for forming a bolted connection between the upper surface 86, 87 respectively of the jacks 71, 72 and beam 88 at openings 95, 96.

Each end portion 89, 90 of beam 88 provides receptacles 91, 92 for receiving the feet F that are at one end portion of a bed frame B to be lifted. These can, for example, be the two feet F at the head end portion of a bed frame B or the two feet F at the foot portion of the bed frame B. Each receptacle 91, 92 can have a perimeter wall 93 as shown for preventing slippage of the foot F of the bed frame once that foot F is placed in the appropriate receptacle 91 or 92.

The embodiment of FIG. 5 is not adjustable, but functions similarly to the preferred embodiment of FIGS. 1–4 in that the control panel 74 is used to activate the motor 69 via cable 73 to rotate in either rotational direction for respectively elevating or lowering the beam 88 and thus the bed frame B, as shown in FIG. 3. Further, the control panel 74 provides up and down positions for switching the electrical motor into one or other rotational direction that corresponds to either elevating or lowering the bed frame B. The control panel 74 would also provide a stop position which deactivates the motor drive 69 and thus stops the bed frame B in a desired elevational orientation such as raised, lowered, or an intermediate position therebetween.

PARTS LIST

| | |
|---|---|
| 10 | bed lifting apparatus |
| 11 | motor drive/gear base plate |
| 12 | openings |
| 13 | openings |
| 14 | center section |
| 15 | side panel |
| 16 | side panel |
| 17 | jack base plate |
| 18 | openings |
| 19 | jack base plate |
| 20 | openings |
| 21 | telescope sleeve section |
| 22 | telescope sleeve section |
| 23 | motor drive |
| 24 | gear box |
| 25 | worm gear screw jack |
| 26 | worm gear screw jack |
| 27 | motor shaft |
| 28 | gear box shaft |
| 29 | coupling |
| 30 | gear shaft |
| 31 | gear shaft |
| 32 | sleeve |
| 33 | hexagonal shaft |
| 34 | screw jack drive shaft |
| 35 | screw jack drive shaft |
| 36 | vertical elevating portion |
| 37 | vertical elevating portion |
| 38 | upper surface |
| 39 | upper surface |
| 40 | support beam member |
| 40A | side section |
| 40B | center section |
| 40C | side section |
| 41 | receptacle |
| 42 | receptacle |
| 43 | flat plate |
| 44 | flat plate |
| 45 | side wall |
| 46 | side wall |
| 47 | L-shaped end |
| 48 | L-shaped end |
| 49 | pin |
| 50 | control panel |

PARTS LIST-continued

| | |
|---|---|
| 51 | cable |
| 60 | bed lifting apparatus |
| 61 | base plate |
| 62 | center portion |
| 63 | side portion |
| 64 | side portion |
| 65 | openings |
| 66 | openings |
| 67 | openings |
| 68 | openings |
| 69 | motor drive |
| 70 | gear box |
| 71 | worn gear screw jack |
| 72 | worn gear screw jack |
| 73 | cable |
| 74 | control panel |
| 75 | drive shaft |
| 76 | gear shaft |
| 77 | shaft |
| 78 | shaft |
| 79 | sleeve |
| 80 | shaft |
| 81 | shaft |
| 82 | shaft |
| 83 | shaft |
| 84 | vertical elevating portion |
| 85 | vertical elevating portion |
| 86 | upper surface |
| 87 | upper surface |
| 88 | beam |
| 89 | L-shaped end |
| 90 | L-shaped end |
| 91 | receptacle |
| 92 | receptacle |
| 93 | wall |
| 94 | wall |
| 95 | openings |
| 96 | openings |
| 93 | wall |
| 94 | wall |
| 95 | openings |
| 96 | openings |

The foregoing embodiments are presented by way of example only. The scope of the present invention is to be limited only by the following claims.

What is claimed is:

1. Apparatus for elevating one end portion of a bed frame that includes a pair of floor engaging feet, comprising:

a) a support beam member having opposed end portions, each end portion including a platform and a receptacle on said platform for holding one of the floor engaging feet of one end portion of the bed frame;

b) the support beam member having a intermediate transverse portion positioned at a higher elevation than said platforms and receptacles;

c) a pair of jacks positioned to engage said intermediate transverse portion of said support beam respectively adjacent said receptacles, each jack having a base for resting upon the floor, a lifting portion for lifting the support beam member and a moving portion that elevates the lifting portion relative to the base, each lifting portion connected to the lower surface of said intermediate transverse portion;

d) a reversible motor drive;

e) a gearbox having a motor drive shaft connectable to the motor drive and a pair of opposed drive shafts that extend in opposing directions from the gear box respectively to the pair of jacks for simultaneously operating each of said jacks to move the lifting portion between minimum and maximum elevational positions;

f) a control for controlling the motor drive, the control having "up", "down" and "stop" control positions; and g) wherein when a user operates the motor drive with the control by selecting the "up" or the "down" positions to activate the motor drive, it simultaneously raises or lowers each of the jacks and the support beam adjacent the floor engaging feet of the bedframe thereby supporting the raising and lowering of the bed frame with the floor engaging feet securely received in said receptacles.

2. The apparatus of claim 1 wherein the control includes a flexible cable that extends between the motor drive an a user.

3. The apparatus of claim 1 further comprising base plates that support said motor drive, jacks, and gearbox.

4. The apparatus of claim 3 wherein said base plates, drive shafts and support beam each include telescoping means for providing width for conforming the spacing of the platforms and adjacent jacks to bed frames of differing width.

5. The apparatus of claim 1 wherein said support beam member has a width that is adjustable for varying the distance between said platforms and said pair of opposed drive shafts have lengths which are adjustable for varying the distance of said jacks to remain adjacent said platforms when said distance between said platforms is adjusted.

* * * * *